US011417463B2

(12) United States Patent
Zou et al.

(10) Patent No.: US 11,417,463 B2
(45) Date of Patent: Aug. 16, 2022

(54) METHOD FOR MANUFACTURING COIL, COIL AND ELECTRONIC DEVICE

(71) Applicant: Goertek, Inc., Weifang (CN)

(72) Inventors: Quanbo Zou, Weifang (CN); Zhe Wang, Weifang (CN); Qinglin Song, Weifang (CN); Debo Sun, Weifang (CN)

(73) Assignee: Goertek Inc., Weifang (CN)

( * ) Notice: Subject to any disclaimer, the term of this patent is extended or adjusted under 35 U.S.C. 154(b) by 135 days.

(21) Appl. No.: 16/643,361

(22) PCT Filed: Sep. 5, 2017

(86) PCT No.: PCT/CN2017/100546
§ 371 (c)(1),
(2) Date: Feb. 28, 2020

(87) PCT Pub. No.: WO2019/041366
PCT Pub. Date: Mar. 7, 2019

(65) Prior Publication Data

US 2020/0365321 A1 Nov. 19, 2020

(30) Foreign Application Priority Data

Aug. 30, 2017 (CN) ..... 201710765976.1

(51) Int. Cl.
*H01F 7/06* (2006.01)
*H01F 41/04* (2006.01)
(Continued)

(52) U.S. Cl.
CPC ..... *H01F 41/045* (2013.01); *H01F 5/003* (2013.01); *H01F 41/127* (2013.01)

(58) Field of Classification Search
CPC ..... H01F 5/003; H01F 41/04; H01F 41/045; H01F 41/127; H01F 27/2847; H01F 5/00
See application file for complete search history.

(56) References Cited

U.S. PATENT DOCUMENTS 6,311,389 B1 * 11/2001 Uosaki ..... H01F 41/041 29/605
9,741,490 B2 * 8/2017 Cha ..... H01F 41/042
(Continued)

FOREIGN PATENT DOCUMENTS

CN 103366920 10/2013
CN 104519666 4/2015
(Continued)

*Primary Examiner* — Paul D Kim
(74) *Attorney, Agent, or Firm* — Baker Botts LLP

(57) ABSTRACT

Disclosed are a method for manufacturing a coil, a coil, and an electronic device. The method includes: bonding a first side of a metal sheet onto a laser-transmitting substrate by an adhesive layer; cutting a coil pattern on a second side of the metal sheet by the laser to form a coil running through the two sides of the metal sheet on the metal sheet; bonding the second side of the metal sheet onto an adhesive tape; transmitting the laser through the laser-transmitting substrate to act on the adhesive layer to detach the laser-transmitting substrate and the adhesive layer from the first side of the metal sheet; exposing the coil pattern on the first side of the metal sheet; and forming an encapsulation layer on the coil to encapsulate the first side of the coil.

8 Claims, 2 Drawing Sheets

(51) Int. Cl.
*H01F 5/00* (2006.01)
*H01F 41/12* (2006.01)

(56) References Cited

U.S. PATENT DOCUMENTS

| | | | | |
|---|---|---|---|---|
| 2003/0116790 | A1* | 6/2003 | Kikuchi | G06K 19/07775 257/208 |
| 2011/0047793 | A1 | 3/2011 | Klink | |
| 2013/0249664 | A1 | 9/2013 | Tonoyama et al. | |
| 2015/0028984 | A1* | 1/2015 | Kang | H01F 17/0006 336/192 |
| 2016/0078998 | A1* | 3/2016 | Park | H01F 41/041 336/105 |
| 2017/0032882 | A1* | 2/2017 | Yang | H01F 41/042 |
| 2018/0331032 | A1 | 11/2018 | Yu et al. | |
| 2020/0365320 | A1* | 11/2020 | Zou | H01F 41/127 |

FOREIGN PATENT DOCUMENTS

| | | |
|---|---|---|
| CN | 104665418 | 6/2015 |
| CN | 104992908 | 10/2015 |
| CN | 106129047 | 11/2016 |
| CN | 107026094 | 8/2017 |

* cited by examiner

METHOD FOR MANUFACTURING COIL, COIL AND ELECTRONIC DEVICE

CROSS-REFERENCE TO RELATED APPLICATIONS

This application is a National Stage of International Application No. PCT/CN2017/100546 filed on Sep. 5, 2017, which is hereby incorporated by reference in its entirety.

TECHNICAL FIELD

The present invention relates to the field of processing and manufacturing of components, and more particularly, to a method for manufacturing a coil. The present invention further relates to a coil manufactured by the method and an electronic device employing the coil.

BACKGROUND

As a common component in modern electronic products, a coil may be applied to sound production apparatuses such as a speaker and a receiver, and it may also be applied to a motor, an inductor, a transformer and a loop antenna, as well as the wireless charging field of a smart phone, a smart watch or other wearable electronic devices.

With the development of science and technology, a traditional coil cannot meet the demand for light weight and compactness of the modern electronic products due to its big size, high internal resistance and large weight. Moreover, because of the coil's requirements for working parameters and its relatively special structure, it is difficult to manufacture a high-performance miniaturized coil on a plane substrate by the conventional microelectronic technology.

SUMMARY

An objective of the present invention is to provide a new technical solution of a method for manufacturing a coil.

In one aspect of the present invention, there is provided a method for manufacturing a coil, including:

(a) bonding a first side of a metal sheet onto a laser-transmitting substrate by means of an adhesive layer;

(b) cutting a coil pattern on a second side of the metal sheet by means of laser to form a coil running through the two sides of the metal sheet on the metal sheet;

(c) bonding the second side of the metal sheet onto an adhesive tape, then transmitting the laser through the laser-transmitting substrate to act on the adhesive layer to detach the laser-transmitting substrate, and exposing the coil pattern on the first side of the metal sheet after the adhesive layer is removed;

(d) forming an encapsulation layer on the coil to encapsulate the first side of the coil.

Optionally, the adhesive layer is made from polyimide, benzocyclobutene, polybenzoxazole, epoxy resin, silica gel, an acrylic adhesive, a photoresist, parylene, polyamide or polyurethane.

Optionally, the laser-transmitting substrate is made of laser-transmitting glass or laser-transmitting sapphire.

Optionally, the adhesive tape is a UV tape, and an adhesive tape frame is further disposed at each of two ends of the UV tape.

Optionally, the encapsulation layer is made from polyimide, benzocyclobutene, polybenzoxazole, epoxy resin, silica gel, an acrylic adhesive, a photoresist, parylene, polyamide or polyurethane.

Optionally, the encapsulation layer is formed on the coil by means of whirl coating, spray coating, dispensing, printing or vapor deposition.

Optionally, the step (b) further comprises cutting the metal sheet by means of laser to form an external pad.

Optionally, the metal sheet is made of a copper foil.

In another aspect of the present invention, there is further provided a coil manufactured by the foregoing method.

In yet another aspect of the present invention, there is further provided an electronic device including the above-mentioned coil.

Compared with the prior art, the method provided by the present invention can produce the miniaturized coil having a regular profile by cutting the metal sheet by means of the laser. Pitch and dimensions of the coil can be reasonably selected by adjusting parameters of the laser to guarantee the performance of the coil used with medium and high frequencies. In the method, the laser-transmitting substrate is adopted as a base for manufacture, such that the laser-transmitting substrate is subsequently easy to remove by means of laser degumming or laser stripping. Thus, the coil is prevented from deformation.

Other features and advantages of the present invention will become apparent from the following detailed description of exemplary embodiments of the present invention with reference to the accompanying drawings.

BRIEF DESCRIPTION OF THE DRAWINGS

The accompanying drawings incorporated in the description and forming a part thereof illustrate the embodiments of the present invention and are used to explain the principle of the present invention along therewith.

DETAILED DESCRIPTION

Figure 1:
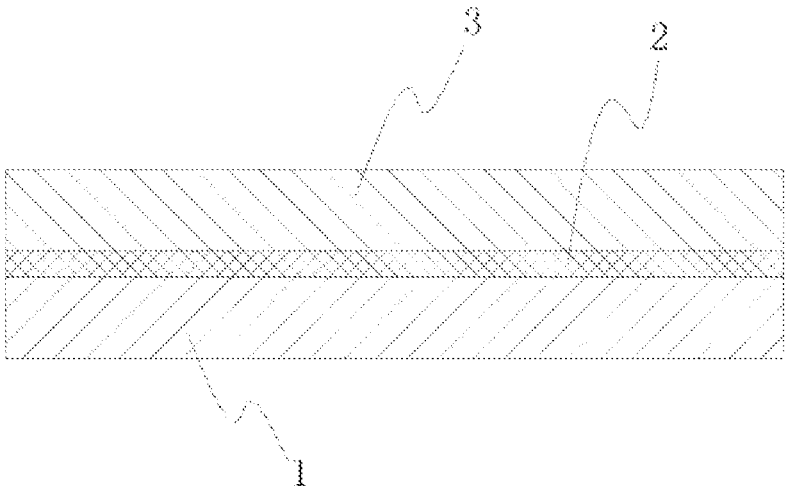
FIGS. 1 to 5 are process flow diagrams of a method for manufacturing a coil according to the present invention.

Various exemplary embodiments of the present invention will now be described in detail with reference to the accompanying drawings. It should be noted that the relative arrangement, numerical expressions and numerical values of the components and steps set forth in these embodiments do not limit the scope of the present invention unless otherwise specified.

The following description of at least one exemplary embodiment is in fact merely illustrative and is in no way intended as a limitation to the present invention and its application or use.

Techniques, methods, and devices known to those of ordinary skill in the relevant art may not be discussed in detail but where appropriate, the techniques, methods, and devices should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, there is no need for further discussion in the accompanying drawings.

The present invention provides a method for manufacturing a coil and a coil manufactured by the method. By this method, the size of the coil may be made very small. The method is low in cost, each process step of the method is a mature procedure, and is suitable for batch production The coil manufactured by the method is controllable in coil pitch, low in internal resistance, small in thermal loss and excellent in electric and thermal conductivity. The coil can be applied to various electronic devices, such as the technical field of inductors, or low-power, medium power and even high-power wireless charging, such as charging of a smart phone, a smart watch or other wearable electronic devices.

FIGS. 1 to 5 are process flow diagrams of a method for manufacturing a coil according to the present invention. In particular, the method includes the following steps.

(a) A first side of a metal sheet 3 is bonded onto a laser-transmitting substrate 1 by means of an adhesive layer 2.

Referring to FIG. 1, the substrate 1 is made of a laser-transmitting material, e.g., glass, sapphire or other laser-transmitting materials well known to those skilled in the art, such that degumming or stripping can be subsequently performed by means of laser.

The adhesive layer 2 is configured to bond the metal sheet 3 onto the laser-transmitting substrate 1 and may be made from an adhesive material well known to those skilled in the art, e.g., polyimide, benzocyclobutene, polybenzoxazole, epoxy resin, silica gel, an acrylic adhesive, a photoresist, parylene, polyamide or polyurethane.

The metal sheet 3 is preferably made of a copper foil owing to favorable electric and thermal conductivity and relative low cost of copper. However, for those skilled in the art, the metal sheet may also be made from other common materials in the field of coils, which will not be listed one by one herein.

(b) A coil pattern 30 is obtained by cutting a second side of the metal sheet 3 by means of laser to form a coil 31 running through the two sides of the metal sheet 3 on the metal sheet 3.

Figure 2:
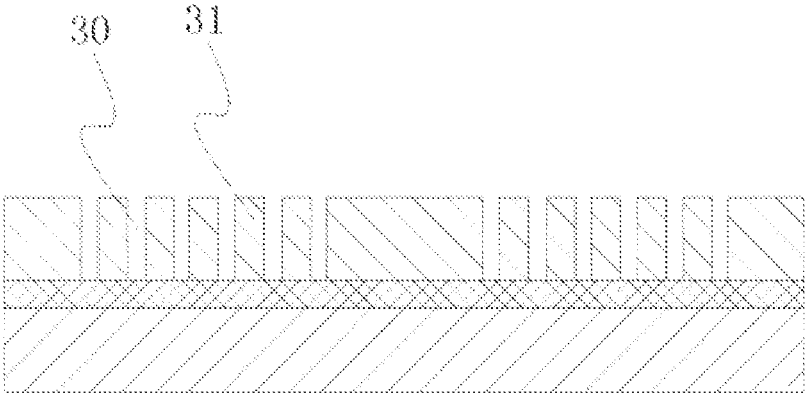

Referring to FIG. 2, the laser cuts the second side of the metal sheet 3 (referring to a view orientation of FIG. 2, the second side of the metal sheet 3 is an upper side) based on a predetermined pattern to obtain the coil pattern 30 on the metal sheet 3 by cutting. Thus, the coil 31 that runs through the upper side and the lower side of the metal sheet 3 by circles is formed on the metal sheet 3. By adjusting parameters of the laser, dimensions and pitch of the coil 31 can be controlled.

(c) The second side of the metal sheet 3 is bonded onto an adhesive tape 4, then, the laser is transmitted through the laser-transmitting substrate 1 and acts on the adhesive layer 2 to detach the laser-transmitting substrate 1 from the first side of the metal sheet 3, and the coil pattern 30 on the first side of the metal sheet 3 is exposed after the adhesive layer 2 is removed.

Figure 3:
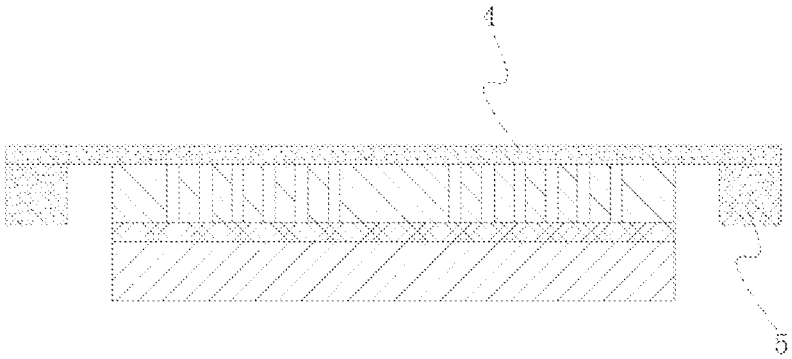

Referring to FIG. 3, since the second side of the metal sheet 3 is bonded onto the adhesive tape 4, product transportation and product feeding in use may be facilitated. In a preferred embodiment of the present invention, the adhesive tape 4 is a UV tape, and an adhesive tape frame 5 by which overall positioning can be achieved is further disposed at each of two ends of the UV tape.

Figure 4:
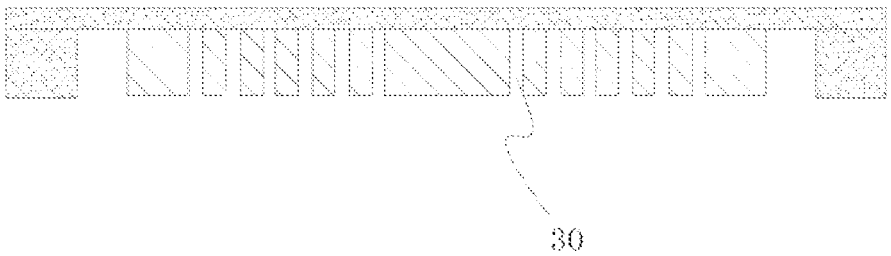

As the laser is transmitted through the laser-transmitting substrate 1 and acts on the adhesive layer 2, adhesion between the adhesive layer 2 and the laser-transmitting substrate 1 vanishes (or is reduced), and the laser-transmitting substrate 1 is detached to achieve a laser degumming or laser stripping effect. After that, the adhesive layer 2 is removed, such that the coil pattern 30 on the first side (a lower side of the metal sheet 3) of the metal sheet 3 may be exposed, as shown in FIG. 4.

A method for removing the adhesive layer 2 depends on its material. For example, where the adhesive layer 2 is made from a 3M LC5000 series adhesive, a standard batch production process is to have another adhesive tape adhered to the adhesive layer 2 and to tear it off. If the adhesive layer 2 is made from a photoresist, it may be washed off with a photoresist removing liquid. The method for removing the adhesive layer 2 is known to those skilled in the art, and thus is not described in detail herein.

d) An encapsulation layer 6 is formed on the coil 31 to encapsulate the first side of the coil 31.

Figure 5:
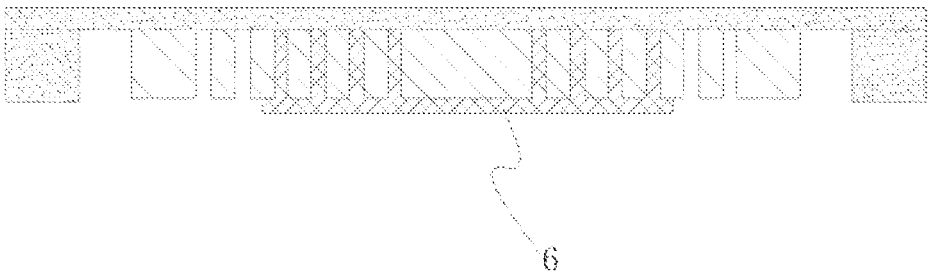
Figure 6:
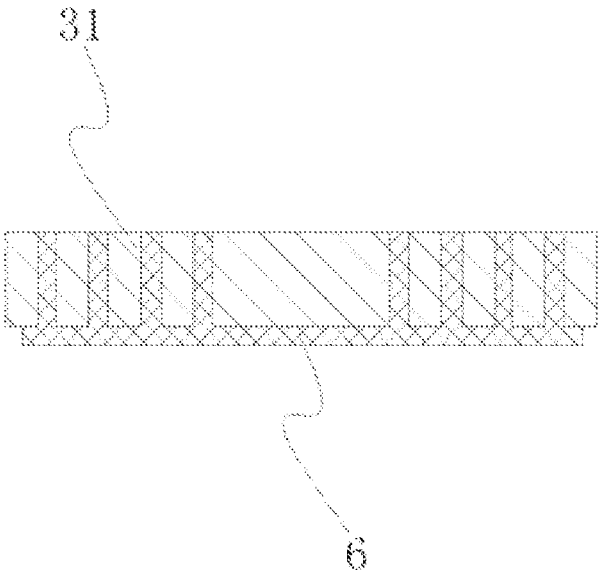
FIG. 6 is a schematic diagram of a coil encapsulation structure according to the present invention.

Referring to FIG. 5, the encapsulation layer 6 mainly functions to insulate and protect the coil 31, and the encapsulation layer 6 and the adhesive layer 2 may be made from the same or different materials. In a specific embodiment of the present invention, the encapsulation layer 6 may be made from an adhesive material well known to those skilled in the art, e.g., polyimide, benzocyclobutene, polybenzoxazole, epoxy resin, silica gel, an acrylic adhesive, a photoresist, parylene, polyamide or polyurethane.

In its forming process, the encapsulation layer 6 may be formed on a first side of the coil 31 by whirl coating, spray coating, dispensing, printing, vapor deposition, or other means well known to those skilled in the art, to encapsulate the first side of the coil 31.

According to the present invention, a coil encapsulation structure is bonded onto the adhesive tape 4 with reference to the structure shown in FIG. 5. When necessary, an adhesive face of the adhesive tape 4 may lose its adhesiveness (or the adhesiveness becomes very low) by being exposed to UV, such that the coil encapsulation structure can be easily picked up from the adhesive tape 4. For example, it can be picked up by a vacuum nozzle and conveyed to an assembly station.

Compared with the prior art, the method provided by the present invention can produce the miniaturized coil having a regular profile by cutting the metal sheet by means of the laser. Pitch and the dimensions of the coil can be reasonably selected by adjusting parameters of the laser to guarantee the performance of the coil at when used at medium and high frequencies. In the method, the laser-transmitting substrate is adopted as a base for manufacture, which is easy to remove afterwards by means of laser degumming or laser stripping. Thus, the coil is prevented from [damaging].

In a preferred embodiment of the present invention, the step (b) further includes cutting the metal sheet 3 by means of laser to form an external pad. The coil 31 may be connected to an external line by the formed external pad.

It should be noted herein that since the external pad is configured to weld with the external line, the external pad needs to be exposed in the encapsulation procedure of step (d), which will not be described in detail herein.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the invention. The scope of the present invention is subject to the attached claims.

The invention claimed is:

1. A method for manufacturing a coil, comprising:

(a) bonding a first side of a metal sheet onto a laser-transmitting substrate by an adhesive layer;

(b) cutting a coil pattern on a second side of the metal sheet by a laser transmission to form the coil running through the two first and second sides of the metal sheet;

(c) bonding the second side of the metal sheet onto an adhesive tape;

(d) transmitting the laser transmission through the laser-transmitting substrate to act on the adhesive layer to detach the laser-transmitting substrate;

(e) removing the adhesive layer to expose the coil pattern on the first side of the metal sheet; and (d) forming an encapsulation layer on the patterned coil to encapsulate the first side of the coil.

2. The method of claim 1, wherein the adhesive layer is made from polyimide, benzocyclobutene, polybenzoxazole, epoxy resin, silica gel, an acrylic adhesive, a photoresist, parylene, polyamide or polyurethane.

3. The method of claim 1, wherein the laser-transmitting substrate is made of laser-transmitting glass or laser-transmitting sapphire.

4. The method of claim 1, wherein the adhesive tape is a UV tape, and an adhesive tape frame is further disposed at each of two ends of the UV tape.

5. The method of claim 1, wherein the encapsulation layer is made from polyimide, benzocyclobutene, polybenzoxazole, epoxy resin, silica gel, an acrylic adhesive, a photoresist, parylene, polyamide or polyurethane.

6. The method of claim 1, wherein the encapsulation layer is formed on the patterned coil by means of whirl coating, spray coating, dispensing, printing or vapor deposition.

7. The method of claim 1, wherein the cutting further comprises cutting the metal sheet by the laser to form an external pad.

8. The method of claim 1, wherein the metal sheet is made of a copper foil.

* * * * *